United States Patent [19]

DiToro

[11] 3,988,546

[45] Oct. 26, 1976

[54] SYSTEM FOR AUDIBLY RECOGNIZING AN AURALLY UNCLASSIFIABLE SIGNAL

[75] Inventor: Michael J. DiToro, Massapequa, N.Y.

[73] Assignee: General Signal Corporation, Stamford, Conn.

[22] Filed: Sept. 13, 1974

[21] Appl. No.: 505,556

[52] U.S. Cl. ..... 179/15.55 T; 343/8; 179/15.55 R

[51] Int. Cl.[2] ..... G10L 1/02

[58] Field of Search ..... 179/1 SA, 15.55 R, 15.55 T

[56] References Cited

UNITED STATES PATENTS

| | | | |
|---|---|---|---|
| 3,030,450 | 4/1962 | Schroeder | 179/1 SA |
| 3,127,476 | 3/1964 | David | 179/15.55 T |
| 3,409,743 | 11/1968 | Greefkes | 179/15.55 R |
| 3,431,356 | 3/1969 | Copel | 179/1 SH |
| 3,510,590 | 5/1970 | Golla | 179/1 R |
| 3,584,158 | 6/1971 | Jefferies | 179/1 SH |
| 3,643,028 | 2/1972 | Cleveland | 179/1 R |
| 3,855,424 | 12/1974 | Tharmaratnam | 179/15.55 T |

*Primary Examiner*—Kathleen H. Claffy
*Assistant Examiner*—E. S. Kemeny
*Attorney, Agent, or Firm*—Laurence B. Dobbs

[57] ABSTRACT

According to the present invention, a system for audibly recognizing a received signal which is aurally unclassifiable because it is too short or too long in its duration and/or its frequency band is too wide or too narrow, such as occurs in sensor systems, for example, infiltration radars, comprises a signal-storage device such as a magnetic tape recorder/reproducer and motor means for driving the tape at one speed during recording or storage of a received signal and at a different speed, for example a lower speed, during reproducing or retrieval of the signal therefrom. The storage device has means for storing the signal therein as received and means for retrieving the signal from the storage device at a time-rate different from the storing rate, for example a slower rate. Coupled to the tape unit are a plurality of narrow band-pass filters collectively spanning the frequency band of the signal retrieved from the storage device, a plurality of tone generators of audibly distinguishable frequencies, and means responsive to the amplitude of the signal ouput of each of the filters for individually adjusting the amplitude of the signal output of a corresponding one of the tone generators, thus deriving from the signal retrieved from the tape unit a plurality of signals each of a duration and frequency band within the range of audible recognition. The system further includes an output circuit, such as a sound transducer, coupled collectively to the tone generators.

9 Claims, 17 Drawing Figures

FIG. 1A
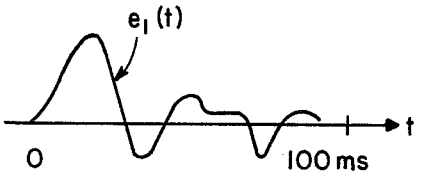
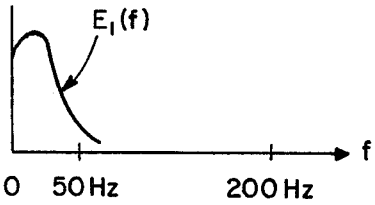
FIG. 2A
FIG. 1B
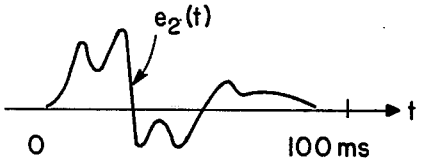
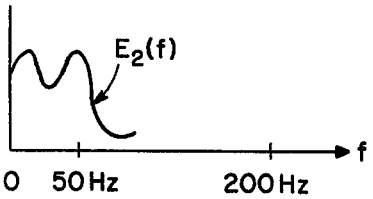
FIG. 2B
FIG. 1C
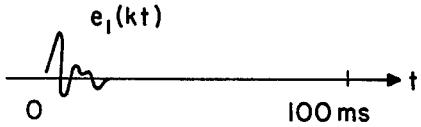
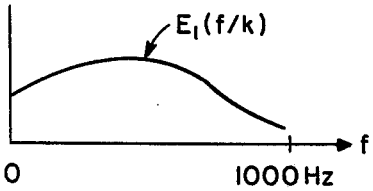
FIG. 2C
FIG. 1D
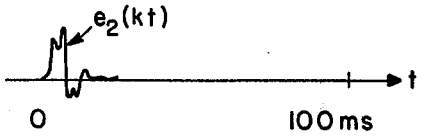
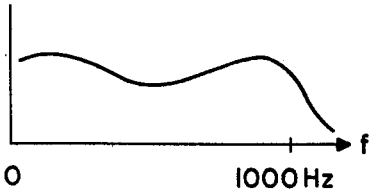
FIG. 2D
FIG. 1E
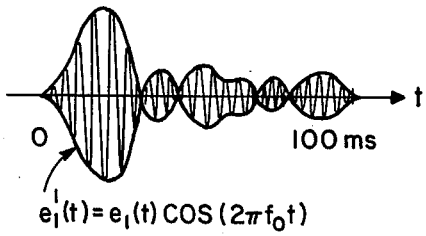
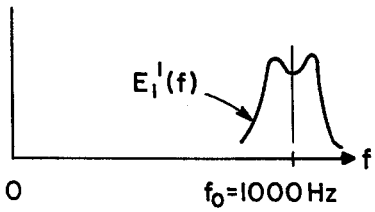
FIG. 2E FIG. 1F
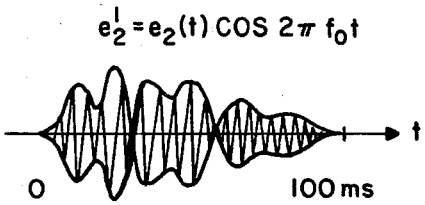
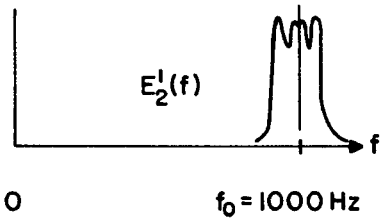
FIG. 2F
FIG. 1G
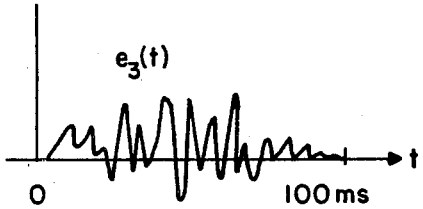
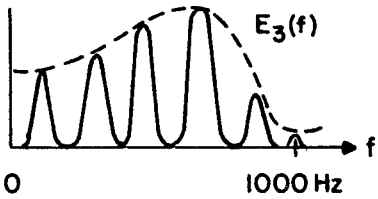
FIG. 2G
FIG. 1H
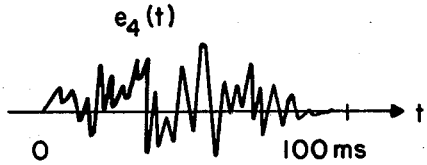
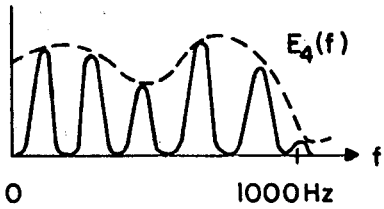
FIG. 2H

SYSTEM FOR AUDIBLY RECOGNIZING AN AURALLY UNCLASSIFIABLE SIGNAL

BACKGROUND OF THE INVENTION

1. Field of the Invention

This invention relates to a system for audibly recognizing a received signal aurally unclassifiable because it is too short or too long in its duration and/or its frequency band is too narrow or too wide. Signals of such types are conventionally received from various sensors such as infiltration radars, seismic exploration sensors, medical diagnostic apparatus, etc. More particularly, this invention relates to a system capable of analyzing a received signal and determining if the signal present is in a category of signals of interest and, if so, just what is its category within a finite number of possible a priori categories. The term "aurally unclassifiable" is used herein and in the appended claims to refer to a signal which carries information in the form in which the listener cannot determine whether or not the information is of a character, or falls in a category, of interest and, if so, in what category it falls; for example, a signal representative of object motion received by an infiltration radar.

2. DESCRIPTION OF THE PRIOR ART

No prior art apparatus similar or equivalent to that of the present invention is known although there have been proposed certain computer-oriented algorithms which can be used to perform the detection and classification of received signals. However, such methods require lengthy computer statistical learning and classification processing. As a result, real-time signal processing is neither possible with a single computer nor economical with multiple paralleled computers.

The system of the present invention may be used in substitution for the ear-brain for performing the functions of learning, detection, and subsequent classification of aurally unclassifiable signals, both economically and in real-time.

SUMMARY OF THE INVENTION

In accordance with the invention, a system for audibly recognizing a received signal aurally unclassifiable because of the frequency band occupied thereby and/or because of its duration comprises a signal-storage device, means for storing the signal in the signal-storage device as received, means for retrieving the stored signal from the device at a time-rate differing from the storing rate, and means for deriving from the retrieved signal a signal having characteristics capable of audible recognition, such signal-deriving means having an output circuit for delivering the derived signal for audible recognition.

Further in accordance with the invention, a system for audibly recognizing a received signal aurally unclassifiable because of the frequency band occupied thereby comprises a plurality of narrow bandpass filters collectively spanning the band of the signal, a plurality of tone generators of audibly distinguishable frequencies, means responsive to the amplitude of the signal output of each of the filters for individually adjusting the amplitude of the signal output of a corresponding one of the tone generators, and an output circuit coupled collectively to the tone generators.

DESCRIPTION OF THE DRAWINGS

FIGS. 1A–1H, inclusive, represent the waveforms of various typical signals which may be received by various sensors with or without subsequent processing;

FIGS. 2A–2H, inclusive, represent the frequency spectra of the similarly lettered waveforms of FIGS. 1A–1H, respectively; while

DESCRIPTION OF THE PREFERRED EMBODIMENT

Figure 3:
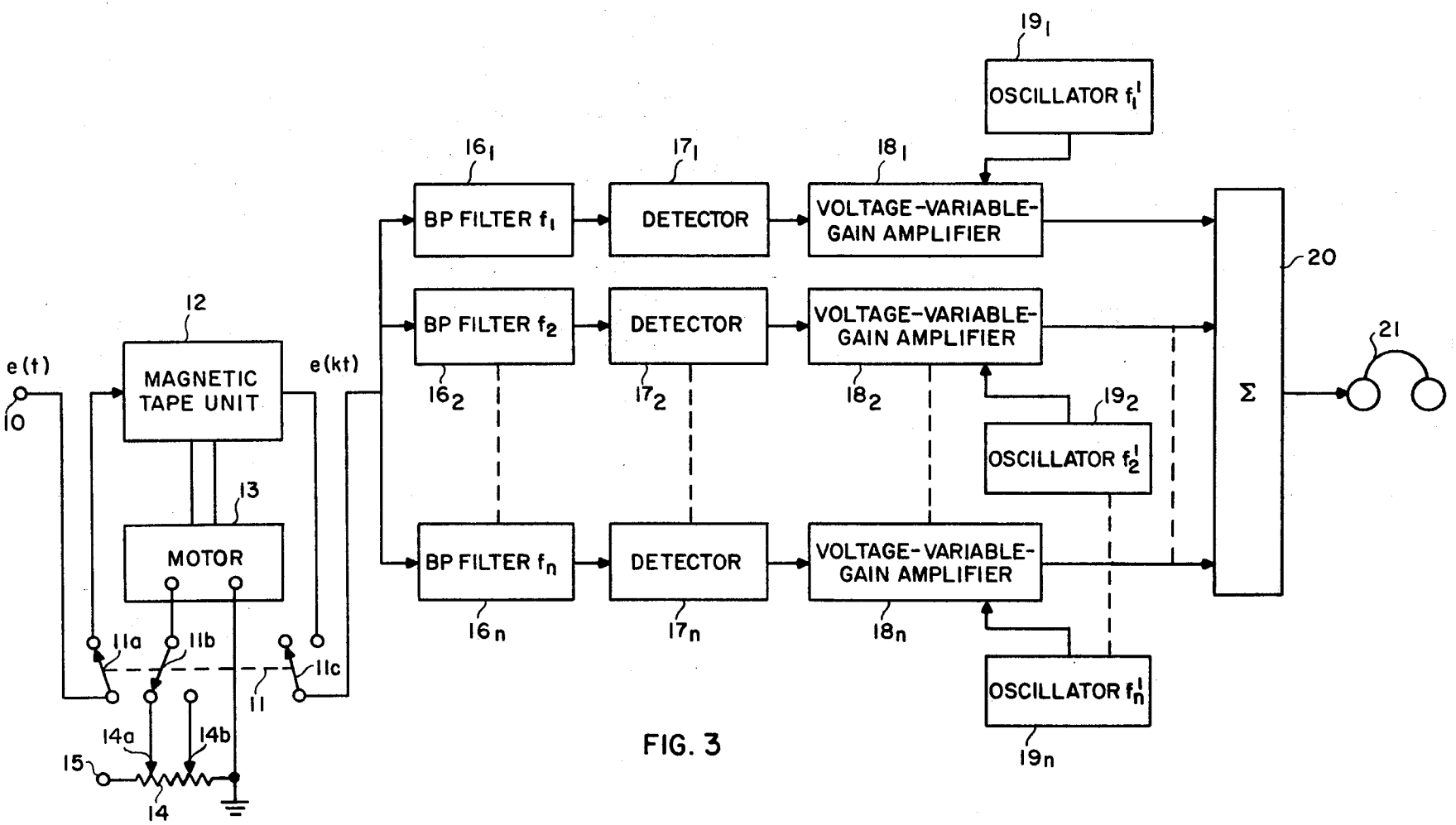
FIG. 3 is a schematic diagram of a system capable of audibly detecting and classifying a wide range of aurally unclassifiable signals including those represented by FIGS. 1A–1H, inclusive.

Before describing the physical apparatus in which the present invention is embodied, it is believed that it would be helpful to consider the characteristics of the signals typical of those generated by various sensors and point out why they may be aurally unrecognizable or unclassifiable as to category. For example, in FIG. 1A is represented a typical baseband signal of a type referred to as category A received by a sensor and having a duration of approximately 100 ms. while FIG. 2A represents the frequency spectrum of the signal which shows that it extends from 0 to approximately 50 Hz. If an attempt is made to listen directly to the signal $e_1(t)$, its spectrum $E_1(f)$ shows that what would be heard is just a "thump".

Again, the signal $e_2(t)$, shown in FIG. 1B, represents another signal of a quite different waveform and frequency spectrum of a type referred to as category B but, because of its low frequency band, it is not possible aurally to distinguish its thump from the thump of the signal of FIG. 1A.

If, now, the signals of FIGS. 1A and 1B are speeded up by the factor $k$ to become $e_1(kt)$ and $e_2(kt)$ with $k$, for example, having a value of 20, the resultant waveforms and frequency spectra are represented by FIGS. 1C, 1D and 2C, 2D respectively. It is seen that the resultant spectra $E_1(f/k)$ and $E_2(f/k)$ have been desirably spread into a frequency band of 0 to 1,000 Hz, which extends well into the range of audibility. However, the duration of the time signals $e_1(kt)$ and $e_2(kt)$ is now reduced to something of the order of 5 ms., which is insufficient for the ear-brain to perform accurate frequency analysis. Accordingly, each of the signals of FIGS. 1C and 1D would be heard merely as a click without the needed tonal characteristics required to separate the clicks from each other. Both the thumps of insufficient frequency span (FIGS. 1A, 1B) and the clicks of insufficient time duration (FIGS. 1C, 1D) may be avoided by using a conventional frequency translation process, such as double-side-band amplitude modulation represented by FIGS. 1E, 1F. Then, neither thumps nor clicks are heard but rather a short tonal sound of frequency around 1,000 Hz. Unfortunately, the fine grain spectral difference between the signals of FIGS. 2E and 2F cannot be aurally distinguished to allow satisfactory aural recognition of these signals as of category A or category B.

In order to determine the nature of the transformation of the signals of FIGS. 1A, 2A and 1B, 2B necessary to permit them to be readily distinguished, recognized, and classified aurally, it is necessary to consider the psycho-acoustical properties of the hearing process as given in the following Table:

TABLE

| Center frequency Hz | (a)* Critical bandwidth Hz | (b)** Minimum-tone duration required for beginning of pitch recognition, ms. | (a).(b) |
|---|---|---|---|
| 125 | 54 | 24 | 1.30 |
| 250 | 48 | 17 | .82 |
| 500 | 52 | 13 | .68 |
| 1,000 | 64 | 10 | .64 |
| 2,000 | 98 | 9 | .88 |
| 4,000 | 200 | 8 | 1.60 |

*See "Handbook of Experimental Psychology", S. S. Stevens, John Wiley, 1960, FIG. 18, p. 1009.
**Id. FIG. 36, p. 1024.

In the Table, the second column lists the average critical bandwidths of hearing as a function of their frequency location. In a frequency span from 200 to 4,000 Hz, there are about 50 critical bands. In essence, this means that a 50-parameter or dimension vector can be simultaneously handled by the ear-brain for detection and classification.

In the third column of the Table are listed, also as a function of frequency, the minimum duration of a tone for the ear-brain to begin to attribute a tonal quality to the signal being heard. Of interest also is the last column of the Table, representing the product of the second and third columns. This is the frequency-time uncertainty cell area of the hearing process. In the range of interest, say from 200 to 4,000 Hz, this product varies only over a range of about 2 to 1.

The implementation to be described utilizes this multidimensional ear-brain temporal spectrum analysis capability, along with its learning capability, to detect and subsequently to classify any unknown waveforms describable by a set of about 50 frequency cells with time durations of 10 to 20 ms.

The generic problem is to provide a time, frequency, or combined time-frequency signal transformation which results in a signal simultaneously having a sufficient time duration to allow aural spectral resolution and also having a frequency-resolution span falling within the aural critical bands and a frequency span roughly extending from 200 to 4,000 Hz.

A system for audibly recognizing a received signal aurally unclassifiable because of its short or long duration and/or the frequency band occupied thereby is represented by the schematic signalflow diagram of FIG. 3. Referring to FIG. 3, a signal $e(t)$ to be recognized is applied to input terminal 10 which is connected via a switch element 11*a* of a three-pole double-throw switch 11 to a magnetic tape unit 12 driven by a motor 13 selectively energized at either of two voltages from a voltage-divider 14 connected between a supply terminal 15 and ground, as illustrated. One of the terminals of the motor 13 is connected to ground, as indicated, while the other terminal may be selectively connected to either of adjustable contacts 14*a* or 14*b* of the voltage-divider 14 through switch element 11*b* of switch 11. This is the circuit connection in which the received signal $e(t)$ is recorded on the magnetic tape unit 12.

After recording, the switch 11 is operated to its right-hand position in which the signal $e(kt)$ may be read out and applied via switch element 11*c* of switch 11 to a series of narrow band-pass filters $\mathbf{16}_1, \mathbf{16}_2 \ldots \mathbf{16}_n$. The filters $\mathbf{16}_1 \ldots \mathbf{16}_n$ have center frequencies $f_1 \ldots f_n$ which, collectively, span the frequency band of the signal $e(kt)$. The filters $\mathbf{16}_1 \ldots \mathbf{16}_n$ are connected to detectors $\mathbf{17}_1 \ldots \mathbf{17}_n$, respectively, which are effective to derive control voltages varying with the amplitude of the components of the signal $e(kt)$ passed by the filters $\mathbf{16}_1 \ldots \mathbf{16}_n$, respectively. These detectors are, in turn, connected to a plurality of voltage-variable-gain amplifiers $\mathbf{18}_1 \ldots \mathbf{18}_n$.

The system of FIG. 3 also includes a plurality of tone generators or oscillators $\mathbf{19}_1 \ldots \mathbf{19}_n$ of frequencies $f'_1 \ldots f'_n$ which preferably lie in appropriate ones of different critical bands of hearing. The oscillators $\mathbf{19}_1 \ldots \mathbf{19}_n$ are connected to the amplifiers $\mathbf{18}_1 \ldots \mathbf{18}_n$, respectively, the gains of which are controlled by the outputs of the detectors $\mathbf{17}_1 \ldots \mathbf{17}_n$, respectively, as described. Thus the oscillators $\mathbf{19}_1 \ldots \mathbf{19}_n$ and their associated amplifiers $\mathbf{18}_1 \ldots \mathbf{18}_n$ comprise means responsive to the signal output of each of the filters $\mathbf{16}_1 \ldots \mathbf{16}_n$ for individually adjusting the amplitude of the signal output of the corresponding one of the tone generators or oscillators $\mathbf{19}_1 \ldots \mathbf{19}_n$. The outputs of the amplifiers $\mathbf{18}_1 \ldots \mathbf{18}_n$ are collectively coupled to a summation amplifier 20 which, in turn, is coupled to a sound transducer such as a pair of earphones 21. To avoid raucous, nonfamiliar sounds which would deter category learning, it is desirable to choose the frequencies $f'_1 \ldots f'_n$ as those of the musical scale, for example, the white keys on a piano. The tempered scale for these white keys, however, requires irrational frequency ratios which are multiples of $2^{(1/12)}$. Because this is difficult to do and maintain, just as it is to keep a piano in tune, the just, rather than the tempered, scale can be used. The advantage gained is that the frequency ratios now become rational fractional integers. Thus, the relative frequency ratios for the tone sequence of the C Major scale, CDEFGABC, are 1, 9/8, 5/4, 4/3, 3/2, 5/3, 15/8, 2. Such a sequence of frequencies is easy to obtain using well-known frequency-dividing circuits.

In the operation of the system of FIG. 3, the received signal $e(t)$ to be recognized is initially recorded on the magnetic tape unit 12 in the conventional manner. After recording, the switch 11 is thrown to its right-hand position so that the recorded signal is then read out as a signal $e(kt)$, where $k$ is the ratio of the read-out speed of tape unit 12 to the recording speed, and applied via the switch element 11*c* to the band-pass filters $\mathbf{16}_1 \ldots \mathbf{16}_n$. During the read-out process, the speed of the motor 13 is adjusted via the switch element 11*b* and the contact 14*a* so that the speed of reproduction may be either slower, in case the duration of the signal $e(t)$ is too short to be recognized, or faster, in case the signal $e(t)$ is of duration too long for convenient listening. In fact, if the duration of the signal $e(t)$ to be received is always of a satisfactory value, the magnetic tape unit 12 and its associated elements may be omitted and the signal $e(t)$ applied directly to the filters $\mathbf{16}_1 \ldots \mathbf{16}_n$.

The signal output of each portion of the frequency band of the received signal $e(t)$ passed by one of the filters $\mathbf{16}_1 \ldots \mathbf{16}_n$ is then detected in the appropriate one of the detectors $\mathbf{17}_1 \ldots \mathbf{17}_n$ to develop a bias or control voltage which is applied to the corresponding one of the variable-gain amplifiers $\mathbf{18}_1 \ldots \mathbf{18}_n$ which, in turn, controls the amplitude of the continuous tone from its respective one of the oscillators $\mathbf{19}_1 \ldots \mathbf{19}_n$.

If the received signal is of the form $e_3(t)$ or $e_4(t)$, as represented by FIGS. 1G and 1H, comprising a plurality of separate identifiable signals of different center frequencies, as represented in the expanded frequency scale of FIGS. 2G and 2H, these signals are applied to the summing or combining amplifier 20 so that the listener, by way of earphones 21, can simultaneously detect the presence of the several components of the received signal $e_3(t)$ or $e_4(t)$. In the event that the received signal characteristically comprises a single identifiable narrow-frequency band, then, of course, only a single one of the channels comprising the filters $16_1 \ldots 16_n$, the detectors $17_1 \ldots 17_n$, and the amplifiers $18_1 \ldots 18_n$ will be required.

While there has been described what is, at present, considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A system for audibly recognizing a received signal aurally unclassifiable because of its improper duration and/or the frequency band occupied thereby comprising:

a signal-storage device;

means for storing the signal in said device as received;

means for retrieving said signal from said device at a time-rate differing from the storing rate;

and means for deriving from said retrieved signal a signal having characteristics capable of audible recognition;

said signal-deriving means having an output circuit for delivering said derived signal for audible recognition.

2. A system for audibly recognizing a received signal aurally unclassifiable because of the frequency band occupied thereby comprising:

a signal-storage device;

means for storing the signal in said device as received;

means for retrieving said signal from said device at a time-rate differing from the storing rate;

and means for deriving from said retrieved signal a signal of a frequency within the range of audibility;

said signal-deriving means having an output circuit for delivering said derived signal for audible recognition.

3. A system for audibly recognizing a received signal of such a duration as to be aurally unclassifiable comprising:

a signal-storage device;

means for storing the signal in said device as received;

means for retrieving said signal from said device at a time-rate differing from the storing rate;

and means for deriving from said retrieved signal a signal of duration and frequency within the range of audible recognition;

said signal-deriving means having an output circuit for delivering said derived signal for audible recognition.

4. A system for audibly recognizing an aurally unclassifiable received signal in accordance with claim 1 in which said signal-storage device is a movable recorder/reproducer and which includes means for moving said recorder/reproducer at one speed during storage of a received signal therein and at a different speed during retrieval of said signal therefrom.

5. A system for audibly recognizing an aurally unclassifiable received signal in accordance with claim 1 in which said signal-storage device is a magnetic tape unit and which includes motor means for driving said tape at one speed during storage of a received signal therein and at a different speed during retrieval of said signal therefrom.

6. A system for audibly recognizing an aurally unclassifiable received signal in accordance with claim 1 in which said signal-deriving means comprises at least one continuously operable audible-tone generator and means responsive to the amplitude of a given component of said retrieved signal for controlling the amplitude of the generated tone.

7. A system for audibly recognizing a received signal aurally unclassifiable because of the frequency band occupied thereby comprising:

a plurality of narrow band-pass filters collectively spanning the band of the signal;

a plurality of continuously operable tone generators of audibly distinguishable predetermined frequencies;

means responsive to the amplitude of the signal output of each of said filters for individually adjusting the amplitude of the signal output of a corresponding one of said generators;

and an output circuit coupled collectively to said tone generators.

8. A system for audibly recognizing an aurally unclassifiable received signal in accordance with claim 7 in which each of said signal generators is an oscillator and a variable-gain amplifier coupled thereto and in which said signal-responsive means comprises a plurality of detectors individually coupling said filters to said amplifiers.

9. A system for audibly recognizing an aurally unclassifiable received signal in accordance with claim 7 which includes a summation amplifier coupled between said generators and said output circuit.

* * * * *